US011092317B2

(12) United States Patent
Mostoller et al.

(10) Patent No.: US 11,092,317 B2
(45) Date of Patent: Aug. 17, 2021

(54) LIGHT SENSOR RECEPTACLE CONNECTOR MOUNTING ADAPTOR

(71) Applicant: TE CONNECTIVITY CORPORATION, Berwyn, PA (US)

(72) Inventors: Matthew Edward Mostoller, Hummelstown, PA (US); Edward John Howard, Millersburg, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/783,267

(22) Filed: Feb. 6, 2020

(65) Prior Publication Data

US 2020/0400287 A1 Dec. 24, 2020

Related U.S. Application Data

(60) Provisional application No. 62/863,946, filed on Jun. 20, 2019.

(51) Int. Cl.

| | |
|---|---|
| ***F21V 23/00*** | (2015.01) |
| ***F21V 31/00*** | (2006.01) |
| ***F21V 17/06*** | (2006.01) |
| ***F21V 23/04*** | (2006.01) |
| ***F21V 17/00*** | (2006.01) |
| ***F21S 8/08*** | (2006.01) |
| ***F21V 17/12*** | (2006.01) |
| *F21W 131/103* | (2006.01) |

(52) U.S. Cl.

CPC ..... *F21V 17/06* (2013.01); *F21S 8/086* (2013.01); *F21V 17/005* (2013.01); *F21V 17/12* (2013.01); *F21V 23/0464* (2013.01); *F21V 31/005* (2013.01); *F21W 2131/103* (2013.01)

(58) Field of Classification Search

CPC .... F21V 17/06; F21V 17/005; F21V 23/0464; F21V 31/005; F21S 8/086

See application file for complete search history.

(56) References Cited

U.S. PATENT DOCUMENTS

| | | | | |
|---|---|---|---|---|
| 5,912,431 A * | 6/1999 | Sheehan | H02G 3/0658 | 174/653 |
| 8,129,633 B1 * | 3/2012 | Shemtov | H02G 3/0675 | 174/652 |
| 8,586,881 B1 * | 11/2013 | Shemtov | F16L 19/065 | 174/652 |
| 8,841,562 B2 * | 9/2014 | Drotleff | H02G 3/0675 | 174/360 |

(Continued)

*Primary Examiner* — Arman B Fallahkhair

(57) ABSTRACT

A lighting receptacle assembly for mounting to a fixture housing of a light fixture and for mating with a sensor connector having a photocontrol component includes a receptacle connector, a base seal, a mounting nut, a mounting plate, a seal bushing and a locking washer. The receptacle connector including a base holding receptacle contacts and a threaded shaft. The base seal is coupled to the base and the mounting nut is threadably coupled to the threaded shaft. The mounting plate has an opening receiving the threaded shaft. The seal bushing has an opening receiving the threaded shaft being compressed between the mounting plate and the fixture housing. The locking washer has an opening receiving the threaded shaft configured to engage the fixture housing and including a locking feature configured to resist rotation of the lighting receptacle assembly relative to the fixture housing.

20 Claims, 4 Drawing Sheets

(56) References Cited

U.S. PATENT DOCUMENTS

| | | | | |
|---|---|---|---|---|
| 10,401,007 | B1 * | 9/2019 | York | H05B 47/105 |
| 2006/0233627 | A1 * | 10/2006 | Weinstein | F16J 15/3276<br>411/369 |
| 2015/0377659 | A1 * | 12/2015 | Landis | G01D 11/245<br>73/431 |
| 2016/0061428 | A1 * | 3/2016 | Nimma | F21S 8/086<br>362/236 |
| 2016/0312983 | A1 * | 10/2016 | Guercio | F21V 23/0464 |

* cited by examiner

LIGHT SENSOR RECEPTACLE CONNECTOR MOUNTING ADAPTOR

CROSS REFERENCE TO RELATED APPLICATIONS

This application claims benefit to U.S. Provisional Application No. 62/863,946, filed Jun. 20, 2019, titled "LIGHT SENSOR RECEPTACLE CONNECTOR MOUNTING ADAPTOR", the subject matter of which is herein incorporated by reference in its entirety.

BACKGROUND OF THE INVENTION

The subject matter herein relates generally to receptacle connectors for light sensor assemblies of light fixtures.

On street lights and parking lot lights, photocells and the corresponding mating receptacles are typically used to turn the lights on and off based upon the ambient light from the sun. The receptacle connectors are coupled to the light fixture. However, there is a need to provide a sealed connection between the receptacle connectors and the fixture housing of the light fixture to prevent moisture from entering the fixture housing. Additionally, there is a need to maintain the position of the receptacle connector and the sensor connector coupled to the receptacle connector relative to the fixture housing. For example, to ensure optimum photocell efficiency, it is important that the sensor connector holding the photocell points generally in the north direction. Conventional light sensor assemblies aim the photocell by drilling holes in the light fixture in proper positions, which is difficult and time consuming.

A need remains for a cost effective and reliable light sensor assembly for a light fixture.

BRIEF DESCRIPTION OF THE INVENTION

In one embodiment, a lighting receptacle assembly is provided for mounting to a fixture housing of a light fixture and for mating with a sensor connector having a photocontrol component. The lighting receptacle assembly includes a receptacle connector including a base including contact channels holding receptacle contacts and a threaded shaft extending from the base. The lighting receptacle assembly includes a base seal coupled to a bottom of the base. The lighting receptacle assembly includes a mounting nut threadably coupled to the threaded shaft. The lighting receptacle assembly includes a mounting plate having an opening receiving the threaded shaft between a top and a bottom facing an exterior of the fixture housing with the base seal sealed against the top of the mounting plate. The lighting receptacle assembly includes a seal bushing having an opening receiving the threaded shaft being compressed between the mounting plate and the fixture housing. The lighting receptacle assembly includes a locking washer having an opening receiving the threaded shaft between a top and a bottom facing the mounting nut with the top of the locking washer configured to engage the fixture housing and including a locking feature configured to resist rotation of the lighting receptacle assembly relative to the fixture housing.

In another embodiment, a light sensor assembly is provided for mounting to a fixture housing of a light fixture. The light sensor assembly includes a sensor connector including a sensor element for sensing an environmental characteristic exterior of the sensor connector including sensor contacts and a lighting receptacle assembly configured to be coupled to the light fixture to control operation of the light fixture. The lighting receptacle assembly includes a receptacle connector including a base including contact channels holding receptacle contacts and a threaded shaft extending from the base. The lighting receptacle assembly includes a base seal coupled to a bottom of the base. The lighting receptacle assembly includes a mounting nut threadably coupled to the threaded shaft. The lighting receptacle assembly includes a mounting plate having an opening receiving the threaded shaft between a top and a bottom facing an exterior of the fixture housing with the base seal sealed against the top of the mounting plate. The lighting receptacle assembly includes a seal bushing having an opening receiving the threaded shaft being compressed between the mounting plate and the fixture housing. The lighting receptacle assembly includes a locking washer having an opening receiving the threaded shaft between a top and a bottom facing the mounting nut with the top of the locking washer configured to engage the fixture housing and including a locking feature configured to resist rotation of the lighting receptacle assembly relative to the fixture housing.

In another embodiment, a light fixture is provided including a fixture housing having a cavity holding a lighting element and wires powering the lighting element and having a port open to the cavity. The light fixture includes a light sensor assembly coupled to the fixture housing at the port. The light sensor assembly includes a lighting receptacle assembly mounted to the fixture housing at the port and a sensor connector coupled to the lighting receptacle assembly. The sensor connector includes a sensor element for sensing an environmental characteristic exterior of the sensor connector including sensor contacts. The lighting receptacle assembly includes a receptacle connector including a base including contact channels holding receptacle contacts and a threaded shaft extending from the base. The lighting receptacle assembly includes a base seal coupled to a bottom of the base. The lighting receptacle assembly includes a mounting nut threadably coupled to the threaded shaft. The lighting receptacle assembly includes a mounting plate having an opening receiving the threaded shaft between a top and a bottom facing an exterior of the fixture housing with the base seal sealed against the top of the mounting plate. The lighting receptacle assembly includes a seal bushing having an opening receiving the threaded shaft being compressed between the mounting plate and the fixture housing. The lighting receptacle assembly includes a locking washer having an opening receiving the threaded shaft between a top and a bottom facing the mounting nut with the top of the locking washer configured to engage the fixture housing and including a locking feature configured to resist rotation of the lighting receptacle assembly relative to the fixture housing.

DETAILED DESCRIPTION OF THE INVENTION

Figure 1:
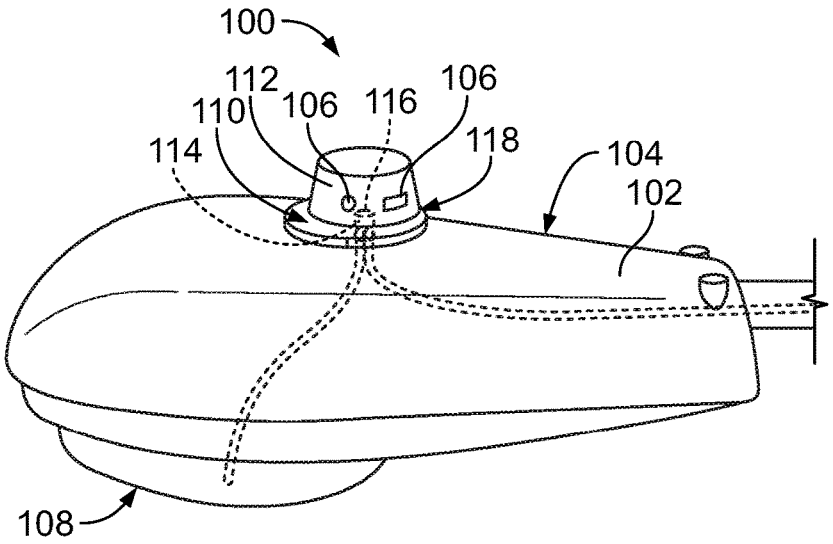
FIG. 1 illustrates a light sensor assembly formed in accordance with an exemplary embodiment.

FIG. 1 illustrates a light sensor assembly 100 formed in accordance with an exemplary embodiment. The light sensor assembly 100 is mounted to a fixture housing 102 of a light fixture 104, such as a roadway light, a parking lot light, a street light, and the like, or to another component, such as the pole or other structure supporting the light fixture 104, or to another component unassociated with the light fixture, such as a parking meter, a telephone pole or another structure. The light sensor assembly 100 holds one or more sensors or sensor components 106 that may be used for environmental monitoring or to control the light fixture 104, such as for turning a lighting element 108 of the light fixture on or off depending upon light levels, for dimming control of the lighting element 108, or for controlling other functions. The lighting element 108 may be an LED lighting element in various embodiments. The sensor components 106 may be used for other functions other than controlling the light fixture 104, such as remote monitoring of the environmental surroundings of the fixture housing 102, such as for parking monitoring, for street flow activity monitoring, or other functions. The sensor components 106 may be a photocell or light sensor used to detect ambient light from the sun. Other types of sensor components 106 such as object identification sensors, motion sensors, timing sensors or other types of environmental sensors may be included in the light sensor assembly 100.

The light sensor assembly 100 includes a lighting receptacle assembly 110 that forms the bottom of the light sensor assembly 100. The lighting receptacle assembly 110 may be directly mounted to the fixture housing 102 of the light fixture 104. The light sensor assembly 100 includes a sensor connector 112 coupled to the lighting receptacle assembly 110. The sensor connector 112 houses or surrounds the sensor component 106, such as to provide environmental protection for the sensor component 106. In an exemplary embodiment, the lighting receptacle assembly 110 is a twist-lock photocontrol receptacle connector and the sensor connector 112 is a twist-lock photocontrol sensor connector, such as connectors being ANSI C136.x compliant.

The connectors 110, 112 include contacts 114, 116 (shown in phantom in FIG. 2), respectively, at a mating interface 118. For example, the contacts 114, 116 may be twist-lock contacts. The contacts 114, 116 may be high voltage power contacts. The contacts 114, 116 may be signal contacts for transmitting data signals across the mating interface 118. The connectors 110, 112 may include other types of contacts 114, 116 other than twist-lock contacts or may not include any contacts but rather be contactless connectors. In an exemplary embodiment, power and data may be transmitted between the sensor connector 112 and the lighting receptacle assembly 110 across the mating interface 118. For example, control signals may be transmitted from the sensor connector 112 to the lighting receptacle assembly 110 for controlling operation of the light fixture 104. The control signals may be based on sensor data gathered by the sensor component 106.

Figure 2:
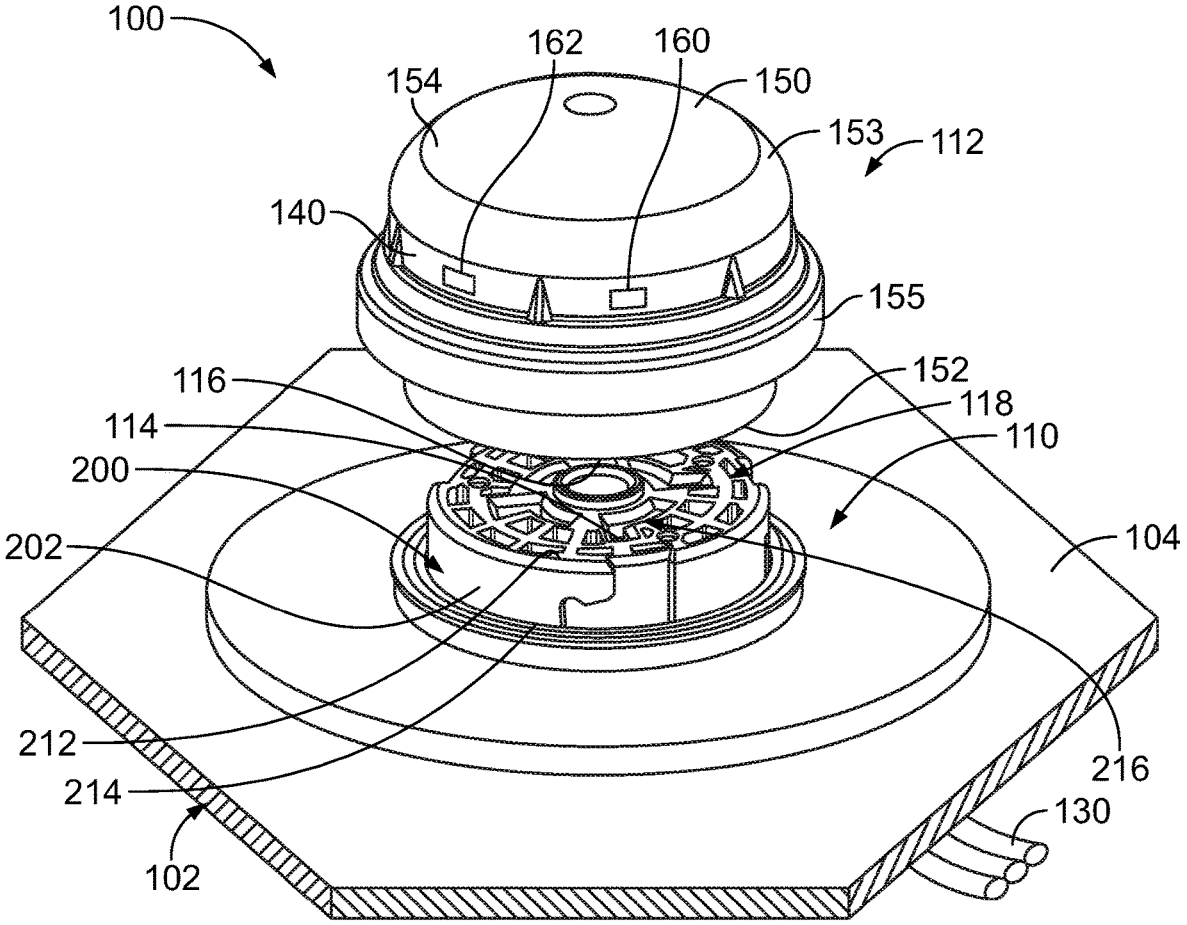
FIG. 2 is an exploded perspective view of the light sensor assembly in accordance with an exemplary embodiment showing a sensor connector poised for mating with a lighting receptacle assembly.

FIG. 2 is an exploded perspective view of the light sensor assembly 100 in accordance with an exemplary embodiment showing the sensor connector 112 poised for mating with the lighting receptacle assembly 110. The connectors 110, 112 hold the contacts 114, 116. Optionally, a seal (not shown) may be provided between the lighting receptacle assembly 110 and the sensor connector 112 to seal the light sensor assembly 100 at the mating interface 118 from environmental containments such as water, debris, and the like.

The light sensor assembly 100 may include wires 130 extending from the lighting receptacle assembly 110. The wires 130 are terminated to corresponding receptacle contacts 114. The wires 130 may be power in or power out wires bringing power to the light sensor assembly 100 from a power source or bringing power from the contacts 114 to another component, such as the lighting element 108 or a driver board for the lighting element of the light fixture 104. In various embodiments, the wires 130 may include a line wire, a load wire, a neutral wire or other types of wires. In other various embodiments, the light sensor assembly 100 does not include the wires 130 extending to/from the lighting receptacle assembly 110, but rather the wires 130 may extend to other components in the light fixture 104.

The light sensor assembly 100 may additionally or alternatively include signal wires (not shown) extending from the lighting receptacle assembly 110. The signal wires may be electrically connected to the receptacle signal contacts. The signal wires may be electrically connected to other components, such as a control module or driver board of the light fixture 104. The signal wires may transmit data to or from the lighting receptacle assembly 110 for data communication with the sensor connector 112.

The lighting receptacle assembly 110 includes a receptacle connector 200 configured to mat with the sensor connector 112. The receptacle connector 200 includes a base 202 and a threaded shaft 204 extending from the base 202. The base extends between a top 212 and a bottom 214 opposite the top 212. The threaded shaft 204 extends from the bottom 214 of the base 202. The base 202 is configured to be secured to the fixture housing 102. The base 202 holds the contacts 114 and the signal contacts. Optionally, the contacts may be entirely contained within the base 202 and protected from the environment by the base 202. For example, the contacts 114 may be held in contact channels 216 within the base 202. The contact channels 216 may extend through the threaded shaft 204. The wires 130 may extend from the contact channels 216 at the bottom of the threaded shaft 204. Optionally, the contact channels 216 include arcuate or curved slots or openings in the base 202 for twist-lock mating with the sensor contacts.

In an exemplary embodiment, the receptacle connector 200 is generally cylindrical shaped, such as to allow easy rotation of the sensor connector 112 relative to the receptacle connector 200 and/or to allow easy rotation of the receptacle connector 200 relative to the fixture housing 102. Optionally, the receptacle connector 200 may be stepped, such as with the base 202 may have a larger diameter than the threaded shaft 204. However, the receptacle connector 200 may have other shapes and alternative embodiments. In an exemplary embodiment, the sensor connector 112 may be rotatable relative to the lighting receptacle assembly 110, such as to allow rotating mating of the sensor connector 112 with the lighting receptacle assembly 110.

The sensor connector 112 includes a housing 140 extending between a top 150 and a bottom 152 opposite the top 150. The housing 140 has a mating interface at the bottom 152 configured to be secured to the lighting receptacle assembly 110. In an exemplary embodiment, the sensor connector 112 includes a sensor lid 154 at the top 150 of the housing 140. The sensor lid 154 may include a dome at the top thereof and a skirt 155 at the bottom thereof circumferentially surrounding the base 202 of the lighting receptacle assembly 110. In an exemplary embodiment, the second connector 112 is cylindrical shaped, such as to allow easy rotation of the sensor connector 112 relative to the lighting receptacle assembly 110, such as during mating. However, the sensor connector 112 may have other shapes and alternative embodiments.

The contacts 116 are arranged in the housing 140 and may be terminated to a circuit board (not shown). The housing 140 holds the sensor(s) 106. The sensor component 106 and/or other components may be mounted to the circuit board. For example, a control module and/or communication device may be mounted to the circuit board. The contacts 116 extend from the bottom 152 of the sensor connector 112 for mating with the receptacle contacts 114 (and receptacle signal contacts). The contacts 116 may be arranged generally around a central axis. Optionally, the contacts 116 may be twist lock contacts. For example, the contacts 116 may be curved and fit in the curved contact channels 216 in the receptacle connector 200 to mate with corresponding curved receptacle contacts 114. In an exemplary embodiment, the sensor connector 112 may be twisted or rotated to lock the contacts 116 in the receptacle connector 200, such as in electrical contact with the receptacle contacts 114. For example, the contacts 116 may be twist-lock contacts that are initially loaded into the contact channels 216 in a vertical direction and the sensor connector 112 is then rotated, such as approximately 35 degrees, to lock the contacts 116 in the receptacle connector 200. Other types of mating arrangements between the contacts 116 and the receptacle connector 200 are possible in alternative embodiments.

In an exemplary embodiment, the sensor connector 112 includes different types of environmental sensor components 106 for sensing different events. For example, the sensor connector 112 includes a photocell 160. The photocell 160 is used for sensing ambient light and is used to control operation of the light fixture 104, such as for turning the light fixture 104 on or off depending upon light levels or for dimming control of the light fixture 104. Optionally, the photocell 160 may be mounted to the circuit board and/or the sensor lid 154. The signal contacts and the photocell 160 may be electrically connected via the circuit board. The circuit board may include additional componentry for signal conditioning. For example, the circuit board may have control circuitry for controlling operation of the light fixture 104, such as including a daylight or nighttime control circuit, a timer circuit, a dimming circuit, and the like. Data from the photocell 160 may be transmitted through the signal contacts across the mating interface 118.

In an exemplary embodiment, the sensor connector 112 includes one or more other environmental sensors 162 for sensing an environmental characteristic other than ambient light exterior of the sensor connector 112 in the environment exterior of the sensor connector 112. For example, the sensor 162 may be a motion sensor or an object sensor configured to sense movement or presence of an object, such as a person or vehicle in a particular area. The sensor 162 may be used for parking monitoring, for street flow activity monitoring, for pedestrian monitoring, or other functions. The sensor 162 may be mounted to the circuit board. In an exemplary embodiment, the sensor 162 is electrically connected to the signal contacts via the circuit board.

Figure 3:
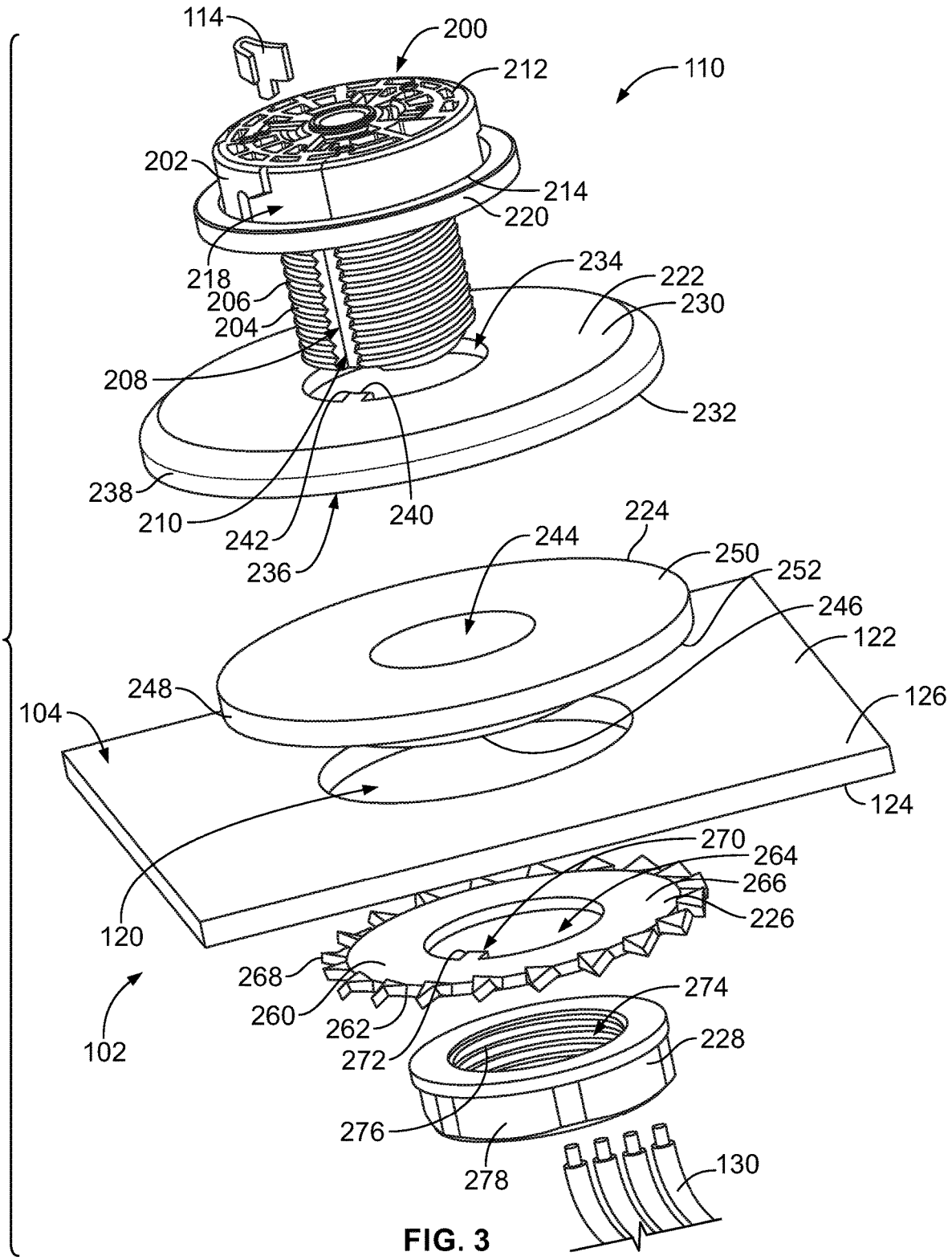
FIG. 3 is an exploded view of the lighting receptacle assembly in accordance with an exemplary embodiment.

FIG. 3 is an exploded view of the lighting receptacle assembly 110 in accordance with an exemplary embodiment. The lighting receptacle assembly 110 is configured to be coupled to the fixture housing 102 of the light fixture 104. In an exemplary embodiment, the lighting receptacle assembly 110 is received in a port 120 extending through a panel 122 of the fixture housing 102. The port 120 may be a standard sized port in the fixture housing 102, such as a 1" opening. In various embodiments, the port 120 is circular. In various embodiments, the port 120 is larger (for example, has a larger diameter) than the receptacle connector 200; however, the lighting receptacle assembly 100 includes a mounting adaptor for supporting the receptacle connector 200 relative to the fixture housing 102. The lighting receptacle assembly 110 allows mounting of the receptacle connector 200 to the fixture housing 102. The port 120 extends between an inner surface 124 and an outer surface 126 of the panel 122. The inner surface 124 faces a cavity of the fixture housing 102. The outer surface 126 faces an exterior of the light fixture 104.

The lighting receptacle assembly 110 includes the receptacle connector 200, a base seal 220, a mounting plate 222, a seal bushing 224, a locking washer 226, and a mounting nut 228. The mounting plate 222, the seal bushing 224 and the locking washer 226 form a mounting adaptor for mounting the receptacle connector 200 to the fixture housing 102 using the mounting nut 228. In various embodiments, the mounting adaptor is used to retrofit the receptacle connector 200 to larger diameter openings, such as the port 120. For example, the receptacle connector 200 may be a Lumawise Endurance S receptacle connector or other commercially available receptacle connector. The receptacle connector 200 may be configured to be mounted to a fixture housing having a smaller diameter port without the need for the mounting plate 222, the seal bushing 224 and the locking washer 226. Rather, the receptacle connector 200 may be mounted to the smaller diameter port simply using the receptacle connector 200 and the mounting nut 228 with the base seal 220 being used to seal the receptacle connector 200 directly to the exterior surface of the fixture housing 102.

In an exemplary embodiment, the mounting nut 228 is configured to be threadably coupled to the threaded shaft 204 of the receptacle connector 200. The threaded shaft 204 passes through the port 120 in the fixture housing 102. The mounting nut 228 and the locking washer 226 are received within the cavity along the inner surface 124 of the panel 122. The seal bushing 224 and the mounting plate 222 are located exterior of the outer surface 126 of the panel 122. The seal bushing 224 provides an environmental seal between the panel 122 and the lighting receptacle assembly 110. The locking washer 226 is coupled to the panel 122 to resist rotation of the lighting receptacle assembly 110 relative to the fixture housing 102.

In an exemplary embodiment, the threaded shaft 204 of the receptacle connector 200 includes threads 206 along the exterior of the threaded shaft 204. The threads 206 are configured to be threadably coupled to the mounting nut 228. The contact channels 216 extend through the base 202 and may extend into and/or through the threaded shaft 204. The receptacle contacts 114 are received in the contact channels 216. The wires 130 are terminated to the receptacle contacts 114, such as being crimped or soldered to the receptacle contacts 114, and extend from the threaded shaft 204.

In an exemplary embodiment, the receptacle connector 200 includes an anti-rotation feature 208 to resist rotation of the receptacle connector 200 relative to the mounting plate 222 and/or the locking washer 226. In the illustrated embodiment, the anti-rotation feature 208 is a keyway 210 formed by a groove or channel formed in the side of the threaded shaft 204. Other types of anti-rotation features may be used in alternative embodiments, such as a flat surface formed along the exterior of the threaded shaft 204 or another type of anti-rotation feature.

In an exemplary embodiment, the receptacle connector 200 includes a latching feature 218 for latchably securing the sensor connector 112 to the receptacle connector 200. In the illustrated embodiment, the latching feature 218 is a latching channel formed in the side of the base 202. For example, the latching channel may include a bayonet type latching feature. Other types of latching features may be used in alternative embodiments.

In an exemplary embodiment, the base seal 220 is coupled to the bottom 214 of the base 202 of the receptacle connector 200. The threaded shaft 204 passes through the base seal 220. The base seal 220 is configured to be sealed against the bottom 214 of the base 202. The base seal 220 is configured to be compressed against the mounting plate 222 and sealed against the mounting plate 222. The base seal 220 provides an environmental seal between the receptacle connector 200 and the mounting plate 222.

The mounting plate 222 extends between a top 230 and a bottom 232. The mounting plate 222 includes an opening 234 therethrough that receives the threaded shaft 204. In an exemplary embodiment, the mounting plate 222 includes a pocket 236 at the bottom 232 that receives the seal bushing 224. In an exemplary embodiment, the mounting plate 222 includes a lip 238 at an outer perimeter of the mounting plate 222 extending between the top 230 and the bottom 232 that defines the pocket 236. The bottom edge of the lip 238 is configured to face the outer surface 126 of the panel 122 of the fixture housing 102.

In an exemplary embodiment, the mounting plate 222 includes an anti-rotation feature 240 interfacing with the anti-rotation feature 208 of the receptacle connector 200 to resist rotation of the receptacle connector 200 relative to the mounting plate 222. In the illustrated embodiment, the anti-rotation feature 240 includes a tab 242 extending into the opening 234. The tab 242 is configured to be received in the keyway 210 to resist rotation of the receptacle connector 200 relative to the mounting plate 222. Other types of anti-rotation features may be used in alternative embodiments.

In an exemplary embodiment, the mounting plate 222 is circular having a diameter greater than a diameter of the base 202. The diameter of the mounting plate 222 is larger than a diameter of the port 120 to ensure that the mounting plate 222 is configured to be coupled to the panel 122. The mounting plate 222 is unable to pass through the port 120. The mounting plate 222 supports the receptacle connector 200 and positions the base 202 at the exterior of the fixture housing 102 for mating with the sensor connector 112.

The seal bushing 224 includes an opening 244 configured to be aligned with the opening 234 of the mounting plate 222 to receive the threaded shaft 204. The seal bushing 224 is compressible between the mounting plate 222 and the panel 122 of the fixture housing 102. In an exemplary embodiment, the seal bushing 224 includes a base ring 246 and a bottom of the seal bushing 224 and an upper flange 248 at a top of the seal bushing 224. The upper flange 248 includes an upper surface 250 and a lower surface 252. The upper surface 250 faces the mounting plate 222 and is configured to sealingly engage the mounting plate 222. Optionally, the upper flange 248 may have a diameter approximately equal to the diameter of the mounting plate 222. For example, the upper flange 248 may fit within the pocket 236 and may abut against the lip 238.

The lower surface 252 faces the outer surface 126 of the panel 122 of the fixture housing 102 and is configured to sealingly engage the fixture housing 102. The base ring 246 extends downward from the lower surface 252. The base ring 246 is configured to be received in the port 120 of the panel 122 of the fixture housing 102. The base ring 246 may be used to locate the seal bushing 224 relative to the fixture housing 102, such as to center the seal bushing 224 within the port 120. Optionally, the base ring 246 may be sealed against the panel 122, such as within the port 120. The base ring 246 may extend into the cavity of the fixture housing 102.

The locking washer 226 extends between a top 260 and a bottom 262. The locking washer 226 includes an opening extending therethrough configured to be aligned with the opening 244 and the opening 234 to receive the threaded shaft 204. In an exemplary embodiment, the locking washer 226 includes a ring body 266 defining the opening 264. The ring body 266 is generally planar. In an exemplary embodiment, the locking washer 226 includes locking features 268 extending from the ring body 266. The locking features 268 are configured to engage the inner surface 124 of the panel 122 to resist rotation of the lighting receptacle assembly 110 relative to the fixture housing 102. In the illustrated embodiment, the locking features 268 are defined by teeth extending around the outer periphery of the ring body 266. The teeth are pointed and configured to bite into the inner surface 124 to the locked the locking washer 226 against the inner surface 124. Other types of locking features may be used in alternative embodiments.

In an exemplary embodiment, the locking washer 226 includes an anti-rotation feature 270 interfacing with the anti-rotation feature 208 of the receptacle connector 200 to resist rotation of the receptacle connector 200 relative to the locking washer 226. In the illustrated embodiment, the anti-rotation feature 270 includes a tab 272 extending into the opening 264. The tab 272 is configured to be received in the keyway 210 to resist rotation of the receptacle connector 200 relative to the locking washer 226. Other types of anti-rotation features may be used in alternative embodiments.

The mounting nut 228 includes an opening 274 configured to be aligned with the opening 264 to receive the threaded shaft 204. In an exemplary embodiment, the mounting nut 228 includes internal threads 276 around the opening 274 configured to be threadably coupled to the threaded shaft 204. The mounting nut 228 includes flat surfaces 278 around the exterior of the mounting nut 228 configured to be gripped or engaged by an operator or tool to rotate the mounting nut 228 relative to the threaded shaft 204. The mounting nut 228 is tightened to the receptacle connector 200 to press the locking washer 226 into locking engagement with the fixture housing 102. As the mounting nut 228 is tightened, the seal bushing 224 and the base seal 220 are compressed to form tight environmental seals between the respective components.

Figure 4:
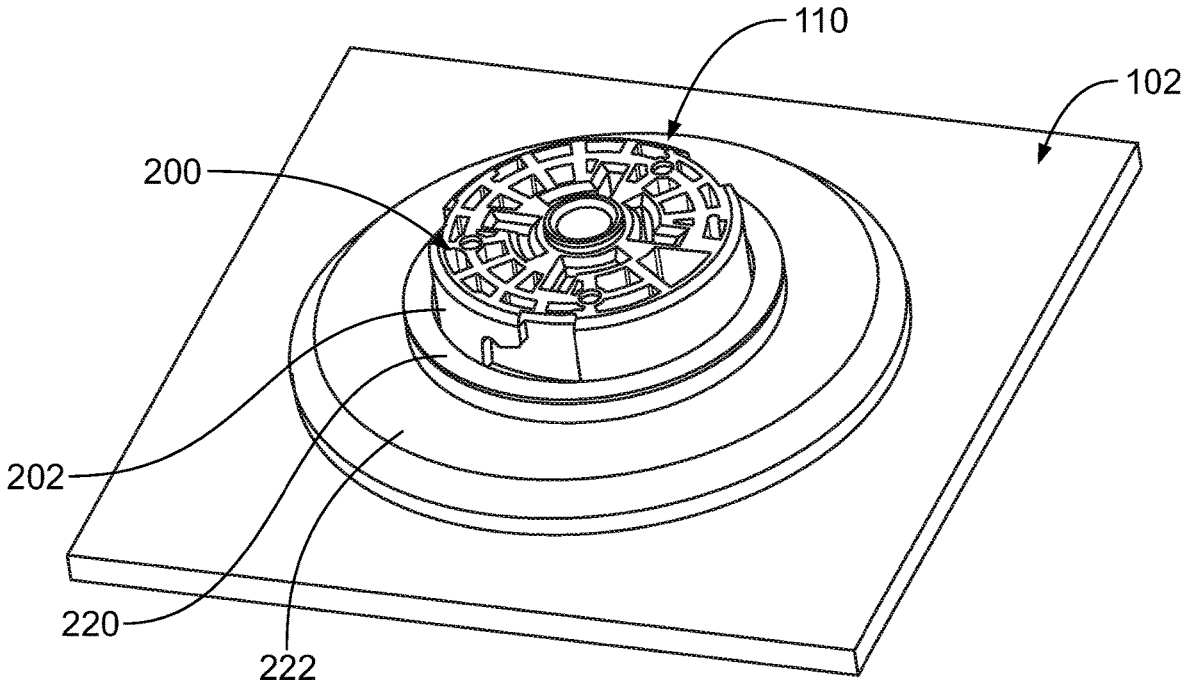
FIG. 4 is a top perspective view of the lighting receptacle assembly coupled to the fixture housing in accordance with an exemplary embodiment.

FIG. 4 is a top perspective view of the lighting receptacle assembly 110 coupled to the fixture housing 102 in accordance with an exemplary embodiment. The base seal 220 is positioned between the base 202 of the receptacle connector 200 and the mounting plate 222. The mounting plate 222 supports the receptacle connector 200 relative to the fixture housing 102 for mating with the center connector 112 (shown in FIG. 2).

Figure 5:
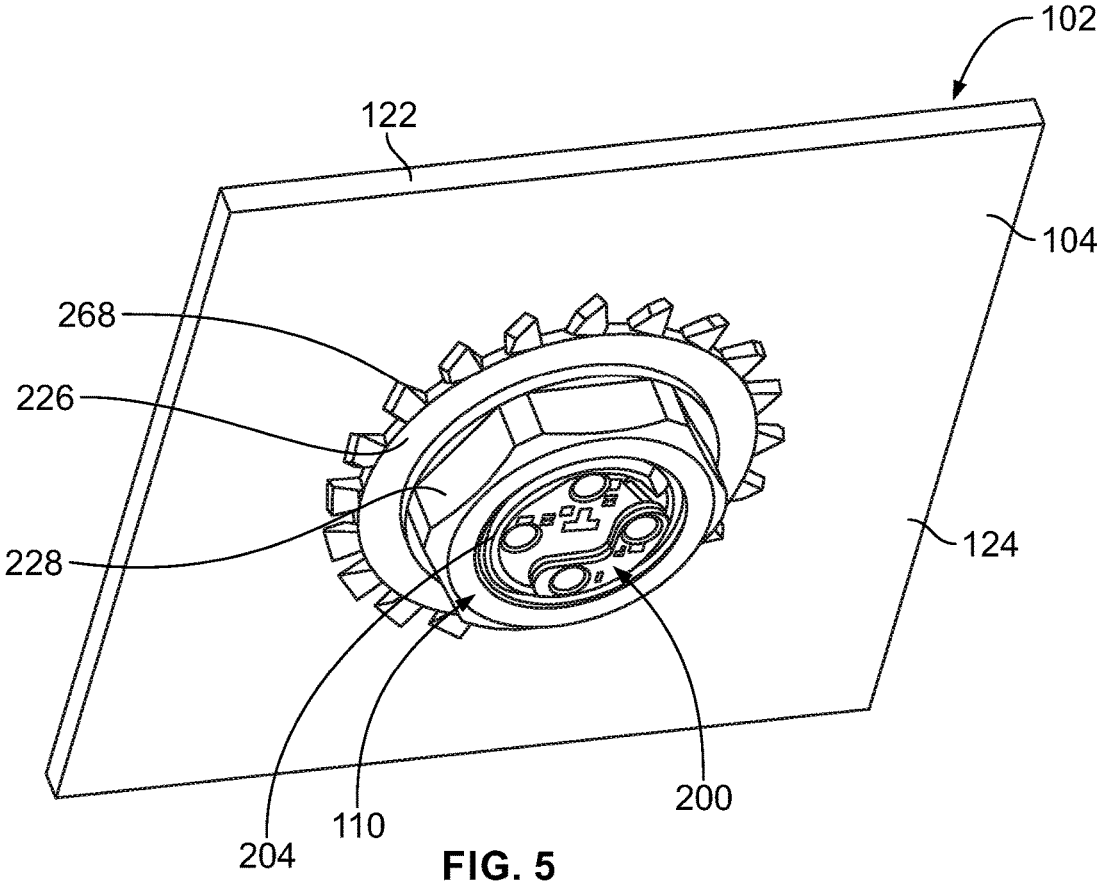
FIG. 5 is a bottom perspective view of the lighting receptacle assembly coupled to the fixture housing in accordance with an exemplary embodiment.

FIG. 5 is a bottom perspective view of the lighting receptacle assembly 110 coupled to the fixture housing 102 in accordance with an exemplary embodiment. The mounting nut 228 is threadably coupled to the threaded shaft 204 of the receptacle connector 200. The contact channels 216 extend through the threaded shaft 204 to receive the contacts and/or the wires. The locking washer 226 is secured between the mounting nut 228 and the inner surface 124 of the panel 122 of the fixture housing 102. The locking washer 226 and the mounting nut 228 are located interior of the panel 122 of the fixture housing 102. The threaded shaft 204 extends through the panel 122 into the fixture housing 102. The locking features 268 of the locking washer 226 interface with the inner surface 124 of the panel 122 to resist rotation of the lighting receptacle assembly 110 relative to the fixture housing 102. As such, when the sensor connector 112 is rotatably coupled to the receptacle connector 200, the lighting receptacle assembly 110 does not rotate relative to the panel 122.

Figure 6:
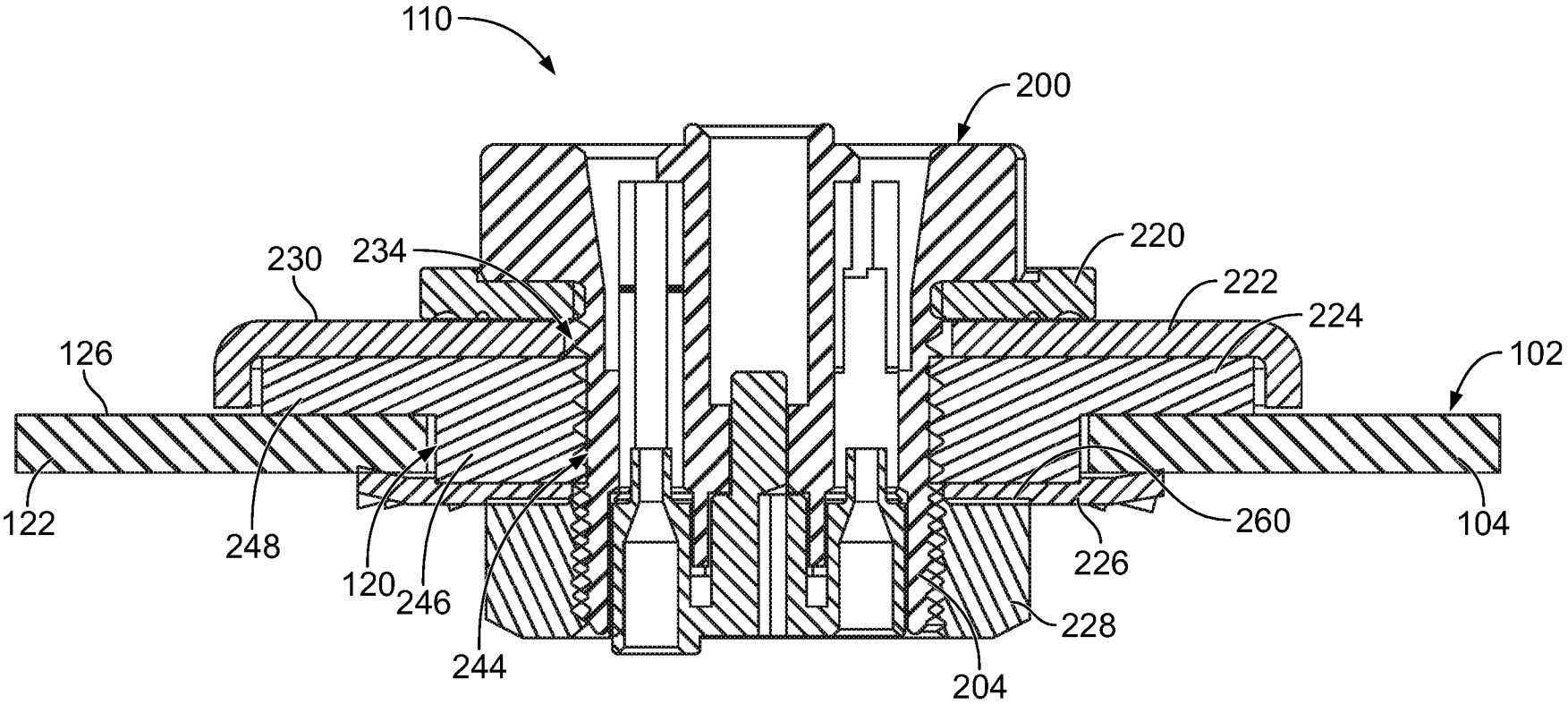
FIG. 6 is a cross-sectional view of the lighting receptacle assembly in accordance with an exemplary embodiment.

FIG. 6 is a cross-sectional view of the lighting receptacle assembly 110 in accordance with an exemplary embodiment. The lighting receptacle assembly 110 is coupled to the panel 122 of the fixture housing 102. During assembly, the seal busing 224 is coupled to the fixture housing 102 with the base ring 246 received in the port 120 and the upper flange 248 along the outer surface 126 of the panel 122. The mounting nut 228 is positioned over the seal busing 224. The threaded shaft 204 of the receptacle connector 200, with the base seal 220 coupled thereto, is loaded into the opening 234 of the mounting plate 222 and the opening 244 of the seal busing 224. The locking washer 226 is coupled to the threaded shaft 204 and the mounting nut 228 is coupled to the threaded shaft 204.

During assembly, the mounting nut 228 is tightened onto the threaded shaft 204 to press the locking washer 226 into the inner surface 124 of the panel 122 of the fixture housing 102. The locking features 268 of the locking washer 226 interface with the inner surface 124 of the panel 122 to resist rotation of the lighting receptacle assembly 110 relative to the fixture housing 102. As such, when the sensor connector 112 is rotatably coupled to the receptacle connector 200, the lighting receptacle assembly 110 does not rotate relative to the panel 122. As the mounting nut 228 is tightened, the base 202 is pulled downward, compressing the base seal 220 against the top 230 of the mounting plate 222. The mounting plate 222 is pulled downward by the base 202 against the seal busing 224. The upper flange 248 of the seal bushing 224 is compressed between the mounting plate 222 and the outer surface 126 of the panel 122 of the fixture housing 102. In an exemplary embodiment, when the mounting nut 228 is tightened, the locking washer 226 is forced upward into the base ring 246 of the seal bushing 224. The bottom of the base ring 246 seals against the top 260 of the locking washer 226. The seal bushing 224 is compressed between the locking washer 226 and the mounting plate 222. The seal bushing 224 may be sealed against the threaded shaft 204. The seal bushing 224 may be sealed against the panel 122 at the port 120. When the mounting nut 228 is tightened, the locking features 268 of the locking washer 226 is forced into the inner surface 124 of the panel 122 to grip against the panel 122 and resist rotation of the lighting receptacle assembly 110 relative to the panel 122.

In the illustrated embodiment, the base 202 has a diameter that is less than a diameter of the port 120. The receptacle connector 200 is able to pass through the port 120 and is unable to be secured to the panel 122 because the diameter of the port 120 is larger than the receptacle connector 200. The mounting plate 222 has a diameter larger than the diameter of the port 120 such that the mounting plate 222 may be secured to the outer surface 126 of the panel 122 to support the base 202 of the receptacle connector 200 relative to the fixture housing 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A lighting receptacle assembly for mounting to a fixture housing of a light fixture and for mating with a sensor connector having a photocontrol component, the lighting receptacle assembly comprising:

a receptacle connector including a base including contact channels holding receptacle contacts, the base having an upper surface configured to receive the sensor connector, the base located exterior of the fixture housing, the receptacle connector including a threaded shaft extending from the base, the threaded shaft located interior of the fixture housing, the receptacle connector including a base seal coupled to a bottom of the base;

a mounting nut threadably coupled to the threaded shaft;

a mounting plate having an opening receiving the threaded shaft, the mounting plate having a top and a bottom, the bottom facing an exterior of the fixture housing, the base seal being sealed against the top of the mounting plate;

a seal bushing having an opening receiving the threaded shaft, the seal bushing being compressed between the mounting plate and the fixture housing; and a locking washer separate and discrete from the mounting nut and from the receptacle connector, the locking washer having an opening receiving the threaded shaft, the locking washer having a top and a bottom, the bottom of the locking washer facing the mounting nut, the top of the locking washer configured to engage the fixture housing, the locking washer including a locking feature configured to resist rotation of the lighting receptacle assembly relative to the fixture housing;

wherein the mounting nut is rotatable relative to the locking washer when threadably coupled to the threaded shaft.

2. The lighting receptacle assembly of claim 1, wherein the receptacle connector includes an anti-rotation feature, the mounting plate including an anti-rotation feature interacting with the anti-rotation feature of the receptacle connector to resist rotation of the receptacle connector relative to the mounting plate.

3. The lighting receptacle assembly of claim 1, wherein the receptacle connector includes an anti-rotation feature, the locking washer including an anti-rotation feature interacting with the anti-rotation feature of the receptacle connector to resist rotation of the receptacle connector relative to the locking washer.

4. The lighting receptacle assembly of claim 1, wherein the receptacle connector includes an anti-rotation feature including a keyway, the mounting plate including an anti-rotation feature including a tab extending into the opening of the mounting plate, the locking washer including an anti-rotation feature including a tab extending into the opening of the locking washer, the tab of the locking washer being aligned with the tab of the mounting plate such that the tabs are received in the keyway to resist rotation of the receptacle connector relative to the mounting plate and the locking washer.

5. The lighting receptacle assembly of claim 1, wherein the mounting plate includes a pocket defined by a lip at an outer perimeter of the mounting plate, the seal bushing received in the pocket.

6. The lighting receptacle assembly of claim 1, wherein the seal bushing includes a base ring at a bottom of the seal bushing and an upper flange at a top of the seal bushing, the upper flange including an upper surface sealingly engaging the mounting plate and a lower surface sealingly engaging the fixture housing, the base ring being received in a port in the fixture housing.

7. The lighting receptacle assembly of claim 1, wherein the locking washer includes locking teeth configured to engage the fixture housing and resist rotation of the locking washer relative to the fixture housing.

8. The lighting receptacle assembly of claim 1, wherein the mounting plate has a first diameter, the base has a second diameter, and the fixture housing has a port therethrough having a third diameter that receives the threaded shaft, the third diameter being larger than the second diameter, the first diameter being larger than the second diameter and the third diameter.

9. The lighting receptacle assembly of claim 1, wherein the mounting nut is tightened to the threaded shaft to compress the base seal and the seal bushing, the mounting nut driving the locking washer into the fixture housing.

10. The lighting receptacle assembly of claim 1, wherein the receptacle contacts are twist lock contacts configured to control lighting of the light fixture.

11. The lighting receptacle assembly of claim 1, wherein the base includes a latching feature for latchably securing the sensor connector to the receptacle connector.

12. The lighting receptacle assembly of claim 1, wherein the seal bushing is sealingly coupled to the locking washer.

13. A light sensor assembly for mounting to a fixture housing of a light fixture, the light sensor assembly comprising:

a sensor connector including a sensor element for sensing an environmental characteristic exterior of the sensor connector, the sensor connector including sensor contacts; and a lighting receptacle assembly configured to be coupled to the light fixture to control operation of the light fixture, the lighting receptacle assembly comprising:

a receptacle connector including a base having an upper surface and contact channels open at the upper surface and holding receptacle contacts, the base receiving the sensor connector at the upper surface such that the sensor contacts are coupled to the receptacle contacts, the base located exterior of the fixture housing, the receptacle connector including a threaded shaft extending from the base, the threaded shaft located interior of the fixture housing, the receptacle connector including a base seal coupled to a bottom of the base;

a mounting nut threadably coupled to the threaded shaft;

a mounting plate having an opening receiving the threaded shaft, the mounting plate having a top and a bottom, the bottom facing an exterior of the fixture housing, the base seal being sealed against the top of the mounting plate;

a seal bushing having an opening receiving the threaded shaft, the seal bushing being compressed between the mounting plate and the fixture housing; and a locking washer separate and discrete from the mounting nut and from the receptacle connector, the locking washer having an opening receiving the threaded shaft, the locking washer having a top and a bottom, the bottom of the locking washer facing the mounting nut, the top of the locking washer configured to engage the fixture housing, the locking washer including a locking feature configured to resist rotation of the lighting receptacle assembly relative to the fixture housing;

wherein the mounting nut is rotatable relative to the locking washer when threadably coupled to the threaded shaft.

14. The light sensor assembly of claim 13, wherein the receptacle connector includes an anti-rotation feature, the mounting plate including an anti-rotation feature interacting with the anti-rotation feature of the receptacle connector to resist rotation of the receptacle connector relative to the mounting plate, the locking washer including an anti-rotation feature interacting with the anti-rotation feature of the receptacle connector to resist rotation of the receptacle connector relative to the locking washer.

15. The light sensor assembly of claim 13, wherein the mounting plate includes a pocket defined by a lip at an outer perimeter of the mounting plate, the seal bushing received in the pocket.

16. The light sensor assembly of claim 13, wherein the seal bushing includes a base ring at a bottom of the seal bushing and an upper flange at a top of the seal bushing, the upper flange including an upper surface sealingly engaging the mounting plate and a lower surface sealingly engaging the fixture housing, the base ring being received in a port in the fixture housing.

17. The light sensor assembly of claim 13, wherein the seal bushing is sealingly coupled to the locking washer.

18. A light fixture comprising:

a fixture housing having a cavity holding a lighting element and wires powering the lighting element, the fixture housing having a port open to the cavity; and a light sensor assembly coupled to the fixture housing at the port, the light sensor assembly including a lighting receptacle assembly mounted to the fixture housing at the port and a sensor connector coupled to the lighting receptacle assembly, the sensor connector including a sensor element for sensing an environmental characteristic exterior of the sensor connector, the sensor connector including sensor contacts, the lighting receptacle assembly comprising:

a receptacle connector including a base having an upper surface and contact channels open at the upper surface and holding receptacle contacts, the base receiving the sensor connector at the upper surface such that the sensor contacts are coupled to the receptacle contacts, the base located exterior of the fixture housing, the receptacle connector including a threaded shaft extending from the base through the port into the cavity of the fixture housing, the receptacle connector including a base seal coupled to a bottom of the base;

a mounting nut threadably coupled to the threaded shaft;

a mounting plate having an opening receiving the threaded shaft, the mounting plate having a top and a bottom, the bottom facing an exterior of the fixture housing, the base seal being sealed against the top of the mounting plate;

a seal bushing having an opening receiving the threaded shaft, the seal bushing being compressed between the mounting plate and the fixture housing; and a locking washer separate and discrete from the mounting nut and from the receptacle connector, the locking washer having an opening receiving the threaded shaft, the locking washer having a top and a bottom, the bottom of the locking washer facing the mounting nut, the top of the locking washer configured to engage the fixture housing, the locking washer including a locking feature configured to resist rotation of the lighting receptacle assembly relative to the fixture housing;

wherein the mounting nut is rotatable relative to the locking washer when threadably coupled to the threaded shaft.

19. The light fixture of claim 18, wherein the receptacle connector includes an anti-rotation feature, the mounting plate including an anti-rotation feature interacting with the anti-rotation feature of the receptacle connector to resist rotation of the receptacle connector relative to the mounting plate, the locking washer including an anti-rotation feature interacting with the anti-rotation feature of the receptacle connector to resist rotation of the receptacle connector relative to the locking washer.

20. The light fixture of claim 18, wherein the seal bushing is sealingly coupled to the locking washer.

* * * * *